US007850037B2

(12) United States Patent
Schmidtner et al.

(10) Patent No.: US 7,850,037 B2
(45) **Date of Patent: *Dec. 14, 2010**

(54) RECLOSABLE LID HAVING A SLIDABLE CLOSURE PANEL

(75) Inventors: Alois A. Schmidtner, Hellerton, PA (US); Jonathan E. Rush, Mount Bethel, PA (US)

(73) Assignee: Dixie Consumer Products LLC, Atlanta, GA (US)

( * ) Notice: Subject to any disclaimer, the term of this patent is extended or adjusted under 35 U.S.C. 154(b) by 747 days.

This patent is subject to a terminal disclaimer.

(21) Appl. No.: 11/695,295

(22) Filed: Apr. 2, 2007

(65) Prior Publication Data

US 2007/0215625 A1 Sep. 20, 2007

Related U.S. Application Data

(63) Continuation-in-part of application No. 11/402,426, filed on Apr. 12, 2006, which is a continuation-in-part of application No. 11/244,133, filed on Oct. 5, 2005.

(60) Provisional application No. 60/617,123, filed on Oct. 8, 2004.

(51) Int. Cl.

| | |
|---|---|
| ***A47G 19/22*** | (2006.01) |
| ***B65D 51/18*** | (2006.01) |
| ***B65D 51/16*** | (2006.01) |
| ***B65D 43/12*** | (2006.01) |

(52) U.S. Cl. ..... 220/713; 220/251.1; 220/254.9; 220/714; 220/715; 220/717; 220/367.1; 229/404; 229/906.1

(58) Field of Classification Search ..... 220/713, 220/345.1, 254.1, 254.4, 254.5, 254.9, 345.2–345.4, 220/350, 351, 717–719, 367.1, 714, 715, 220/380, 711; 222/481; 229/404, 906.1
See application file for complete search history.

(56) References Cited

U.S. PATENT DOCUMENTS

| | | | |
|---|---|---|---|
| 581,293 | A | 4/1897 | Leggett |
| 949,974 | A | 2/1910 | Cibulka |
| 1,433,544 | A | 10/1922 | Gibbs |
| 1,765,284 | A | 6/1930 | Prosnitz |

(Continued)

FOREIGN PATENT DOCUMENTS

| | | |
|---|---|---|
| CA | 2584589 | 10/2007 |

(Continued)

OTHER PUBLICATIONS

International Search Report and Written Opinion for PCT/US2008/058863 mailed Jan. 23, 2009.

(Continued)

*Primary Examiner*—Robin Hylton

(57) ABSTRACT

A reclosable cup lid thermoformed from a polymeric material. The lid includes a closure panel and a lid member having a sidewall and a top wall. The top wall can have an upper and lower side and a drinking aperture at a periphery of the top wall. The top wall can define a pair of engagement tracks disposed on the lower side of the top wall. The engagement tracks can include a scalloped configuration and an undercut depth. The closure panel can be insertable into the scalloped engagement tracks by application of a bending force to the lid member suitable to widen the distance between the tracks.

20 Claims, 5 Drawing Sheets

U.S. PATENT DOCUMENTS

| | | | |
|---|---|---|---|
| 1,888,363 | A | 11/1932 | Tannewitz |
| 2,304,214 | A | 12/1942 | Straub |
| D144,649 | S | 5/1946 | Tobler |
| 2,492,846 | A | 12/1949 | Coyle et al. |
| 2,665,038 | A | 1/1954 | Fowler |
| 3,355,069 | A | 11/1967 | Miles |
| 3,363,798 | A | 1/1968 | Garangiotis |
| 3,938,690 | A | 2/1976 | Butler |
| 4,057,167 | A | 11/1977 | Lee |
| 4,099,642 | A | 7/1978 | Nergard |
| 4,127,212 | A | 11/1978 | Waterbury |
| 4,170,724 | A | 10/1979 | Waterbury |
| 4,187,954 | A | 2/1980 | Striggow |
| 4,201,320 | A | 5/1980 | Eppenbach |
| 4,243,156 | A | 1/1981 | Lobbestael |
| 4,434,906 | A | 3/1984 | Florczyk et al. |
| 4,441,624 | A | 4/1984 | Sokolowski |
| 4,570,817 | A | 2/1986 | Hambleton et al. |
| 4,579,245 | A | 4/1986 | Narushko |
| 4,582,214 | A | 4/1986 | Dart et al. |
| 4,589,569 | A | 5/1986 | Clements |
| D286,026 | S | 10/1986 | Rayner |
| 4,615,459 | A | 10/1986 | Clements |
| 4,629,088 | A | 12/1986 | Durgin |
| 4,746,032 | A | 5/1988 | Huang |
| 4,749,099 | A | 6/1988 | Davis et al. |
| D296,523 | S | 7/1988 | Corno et al. |
| 4,756,440 | A | 7/1988 | Gartner |
| D299,010 | S | 12/1988 | Wall |
| 4,819,829 | A | 4/1989 | Rosten et al. |
| 4,898,299 | A | 2/1990 | Herbst et al. |
| 4,915,250 | A | 4/1990 | Hayes, Jr. et al. |
| 4,986,437 | A | 1/1991 | Farmer |
| 4,989,746 | A | 2/1991 | Pierce |
| 5,025,945 | A | 6/1991 | Lyon |
| 5,065,880 | A | 11/1991 | Horner |
| D323,619 | S | 2/1992 | Wilfong, Jr. et al. |
| 5,086,941 | A | 2/1992 | English et al. |
| D329,604 | S | 9/1992 | Kuczer |
| 5,148,936 | A | 9/1992 | DeGrow |
| 5,186,347 | A | 2/1993 | Freeman et al. |
| 5,253,781 | A | 10/1993 | Van Melle et al. |
| 5,294,014 | A | 3/1994 | Wyatt et al. |
| 5,299,604 | A | 4/1994 | Pierce |
| 5,363,983 | A | 11/1994 | Proshan |
| 5,392,949 | A | 2/1995 | McKenna |
| 5,421,472 | A | 6/1995 | Beckertgis |
| 5,449,085 | A | 9/1995 | Brun, Jr. |
| 5,460,286 | A | 10/1995 | Rush et al. |
| 5,462,189 | A | 10/1995 | Pierce |
| 5,470,817 | A | 11/1995 | Nakamura et al. |
| D368,624 | S | 4/1996 | Forrer |
| 5,538,157 | A | 7/1996 | Proshan |
| 5,657,898 | A | 8/1997 | Portman et al. |
| D385,748 | S | 11/1997 | Iodice et al. |
| 5,938,062 | A | 8/1999 | Paramski |
| D417,845 | S | 12/1999 | Sadlier et al. |
| 6,003,711 | A | 12/1999 | Bilewitz |
| 6,216,904 | B1 | 4/2001 | Cagan |
| 6,220,470 | B1 | 4/2001 | McHenry et al. |
| 6,354,454 | B1 | 3/2002 | Wong |
| 6,419,112 | B1 | 7/2002 | Bruce et al. |
| 6,439,442 | B1 | 8/2002 | Markert et al. |
| D476,567 | S | 7/2003 | Weiss et al. |
| D477,532 | S | 7/2003 | Wong |
| D489,260 | S | 5/2004 | Smith et al. |
| 6,732,875 | B2 | 5/2004 | Smith et al. |
| 6,752,287 | B1 | 6/2004 | Lin |
| 6,824,003 | B1 * | 11/2004 | Wong ..... 220/254.9 |
| D500,428 | S | 1/2005 | Ward et al. |
| 6,883,677 | B2 | 4/2005 | Goeking et al. |
| 6,929,143 | B2 | 8/2005 | Mazzarolo |
| 6,976,577 | B2 | 12/2005 | Devine |
| D516,424 | S | 3/2006 | Schweigert et al. |
| D531,033 | S | 10/2006 | Schmidtner et al. |
| D533,779 | S | 12/2006 | Schmidtner et al. |
| 7,156,251 | B2 | 1/2007 | Smith et al. |
| 7,159,732 | B2 | 1/2007 | Smith et al. |
| 7,246,715 | B2 | 7/2007 | Smith et al. |
| 7,275,653 | B2 | 10/2007 | Tedford, Jr. |
| 2003/0089713 | A1 | 5/2003 | Belt et al. |
| 2005/0103787 | A1 | 5/2005 | Simcovitch |
| 2005/0261771 | A1 | 11/2005 | Paul et al. |
| 2006/0000832 | A1 | 1/2006 | Smith et al. |
| 2006/0071008 | A1 | 4/2006 | Sadlier |
| 2006/0081633 | A1 | 4/2006 | Schmidtner et al. |
| 2006/0201945 | A1 | 9/2006 | Tedford, Jr. |
| 2006/0243734 | A1 | 11/2006 | Tedford, Jr. |
| 2006/0261068 | A1 * | 11/2006 | Schmidtner et al. ..... 220/254.9 |
| 2007/0278228 | A1 | 12/2007 | Wong |

FOREIGN PATENT DOCUMENTS

| | | | |
|---|---|---|---|
| EP | 1247752 | B1 | 2/2004 |
| EP | 1484261 | | 12/2004 |
| FR | 2690671 | | 11/1993 |
| FR | 2780385 | | 12/1999 |
| GB | 2243149 | A | 10/1991 |
| GB | 2416343 | A | 1/2006 |
| GB | 2426970 | A | 12/2006 |
| WO | WO 2006/009450 | A1 | 1/2006 |
| WO | WO 2007/052014 | A1 | 5/2007 |
| WO | WO 2008/021523 | A2 | 2/2008 |

OTHER PUBLICATIONS

PCT International Search Report, Jul. 15, 2008.

J. L. Throne, Thermoforming, published 1987 by Coulthard; pp. 21-29.

* cited by examiner

RECLOSABLE LID HAVING A SLIDABLE CLOSURE PANEL

CROSS-REFERENCE TO RELATED APPLICATIONS

This application is a continuation-in-part of U.S. application Ser. No. 11/402,426 filed Apr. 12, 2006, which is itself a continuation-in-part of U.S. application Ser. No. 11/244,133, filed Oct. 5, 2005, which itself claims priority to U.S. Provisional Application Ser. No. 60/617,123 filed Oct. 8, 2004. The disclosures of each of these aforementioned applications are incorporated herein in their entireties by this reference.

TECHNICAL FIELD

The present invention relates generally to cup lids and, more particularly, to a thermoformed disposable cup lid with a drinking aperture and a closure panel displaceable along a generally radial direction between an open position wherein the aperture communicates with the interior of the lid and a closed position where the closure panel covers the aperture to reduce or substantially prevent spillage in use.

BACKGROUND

Substantial variations are known in the configuration of reclosable lids in general as evidenced by the following: U.S. Pat. No. 581,293 entitled "Can Cover or the Like" of C. H. Leggett; U.S. Pat. No. 949,974 entitled "Closure for Cans" of G. A. Cibulka; U.S. Pat. No. 1,433,544 entitled "Sifter Can" of J. C. Gibbs; U.S. Pat. No. 1,765,284 entitled "Ink Well Closure" of L. B. Pronsnitz U.S. Pat. No. 1,888,363 entitled "Inkwell" of C. E. Tannewitz; U.S. Pat. No. 2,492,846 entitled "Dispensing Container with Slide Closure" of J. Coyle et al.; U.S. Pat. No. 4,170,724 entitled "Vendable Reclosable Beverage Container" of Waterbury; U.S. Pat. No. 4,201,320 entitled "Measuring Dispenser" of Eppenbach; U.S. Pat. No. 4,434,906 entitled "Container Having Resealable Opening Means" of Florczyk et al.; U.S. Pat. No. 5,025,945 entitled "Beverage Container" of Lyon; U.S. Pat. No. 5,086,941 entitled "Dispenser Closure Assembly" of English et al.; U.S. Pat. No. 5,462,189 entitled "Resealable, Refillable Container System" of Pierce; U.S. Pat. No. 6,354,454 entitled "Bottle Cap" of Wong; and U.S. Pat. No. 6,439,442 entitled "Lid With a Slidable Dispensing Spout" of Markert et al. The disclosures of these aforementioned applications are incorporated herein by reference in their entireties.

Reclosable beverage lids or containers are seen in U.S. Pat. No. 4,749,099 entitled "Drink Preserver" of Davis et al.; U.S. Pat. No. 5,470,817 entitled "Slidable Reclosable Plastic Lid" of Hambleton et al.; and U.S. Pat. No. 4,127,212 entitled "Vendable Reclosable Beverage Container" of Waterbury. The disclosures of these aforementioned applications are incorporated herein by reference in their entireties. In Davis et al., a pushpin tab is interconnected to a closure panel within a track formed in the metal top of the container. The push-in tab operates to tear a scored portion down into the top for exposing an opening whereby the closure panel can be moved over the opening to protect unused contents within the container. In Hambleton et al., a plastic container lid includes a main lid member and a slide member. The main lid member has supporting guideways between which the slide member is situated, and the guideways are chamfered relative to the plane of the main lid member so as to hold the slide member on the lid. An aperture is provided in the main lid and the slide member may cover the aperture. The slide member also includes a finger engageable portion. Waterbury is directed to a reclosable beverage container and provides a slidable cap mounted on an upper end of the container for movement over an opening in the lid. The cap cannot be removed from the lid.

The foregoing items are not generally suitable for the disposable lid/cup market where cost, storage, ease of manufacture and so forth are paramount.

With respect to disposable cup lids, closure panels have commonly been incorporated into the upper wall of a plastic lid, defined by scores such that the closure panel is ripped away from the adjacent parts of the cover along the scores and then folded back to open the drinking aperture of the lid; optionally secured in its open position to an upwardly projecting boss; and refolded to the brim to close the lid. These lids can be difficult to operate properly and often allow substantial spillage (especially troublesome with hot beverages) but have nevertheless enjoyed substantial commercial success, because, in part, they satisfy the demanding cost criteria of the disposable products market.

Domed hot cup lids, though not reclosable, have frequently displaced flatter lids with folding type closure panels because they are preferred by consumers and inherently control some spillage due to the fact that they add "splash height" to the cup above a contained beverage. Such lids as are generally known in the art include a dome shape formed from a thermoplastic polymeric material and have an opening for consuming a beverage when the lid is applied to a cup. Various shapes are provided to the lid and the openings and closures formed therein.

A reclosable dome lid is seen in U.S. Pat. No. 6,732,875 entitled "Reclosable Container Lid" of Smith et al. and United States Design Pat. No. D489,260 entitled "Reclosable Container Lid" of Smith et al. The lid includes a cover member and a rotatable disk member mounted in the cover of the lid. A post is located at a periphery of the lid to rotate the disk between open and closed positions beneath the drinking aperture. It is apparently necessary to incorporate features such as drain holes and the like due to the disk/lid geometry and the lid/disk combination appears to require redundant construction of the cover, that is, two layers over the whole top wall. Moreover, the cover features proposed prevent efficient nesting, increasing storage, packaging and transportation costs. The disclosed embodiments furthermore likely prevent stacking in a cup on lid arrangement when multiple beverages are purchased by a consumer; a drawback which might negate spillage gains by closing the drinking aperture.

A further example of reclosable cup lids is shown in U.S. Pat. No. 6,824,003, the disclosure of which is incorporated herein in its entirety by his reference, which purports to disclose a disposable and reclosable thermoformed lid. This lid has C-shaped rails in which a reclosable panel is snapped therein. The rails are tapered to allow snapping into the rails. It is believed that this lid is difficult, if not impossible, to manufacture in a thermoforming process due to the sharp edges formed in the C-shaped rails. Also, it is believed that this lid would not be stackable in an efficient manner.

Despite numerous options, existing and proposed disposable lids have one or more of the following drawbacks: difficulty of operation and ineffective resealing; ineffective spillage control; high material costs; inordinate storage, packaging and shipping costs; inability to stack in a cup on lid arrangement and so forth. By way of the present invention, such deficiencies in the art are overcome and there is provided a reclosable lid which is durable yet disposable, easy to use, stackable, effective for splash and spill prevention, easily manufactured out of a thermoplastic material with existing machinery, and low in cost.

SUMMARY OF INVENTION

The invention provides a disposable, reclosable cup lid thermoformed from a polymeric material and includes a lid member and a closure panel. The thermoformed lid member can be provided with a sidewall and a top wall, a top wall having upper and lower surfaces and a drinking, aperture at a periphery of the top wall. The drinking aperture communicates with an interior of the cup when the lid is engaged with a cup for incorporation of a beverage therein. The top wall can further define a pair of scalloped engagement tracks depending from the lower surface of the top wall and a closure panel post aperture. To provide the reclosable and disposable cup lid, a thermoformed closure panel is inserted into the scalloped engagement tracks by widening of the distance between the scalloped engagement tracks by application of a bending force thereon. The closure panel post will extend above the top surface of the lid member, which will allow the closure panel to be slidable within the scalloped engagement tracks. Further, the lid member and closure panel can be configured to reduce the possibility that the user will experience dripping of the beverage onto her skin or clothing during use by inclusion of a reservoir within the closure panel. The reservoir can also have a vent hole within a boundary thereof to facilitate drainage of the reservoir in use. Still further, the closure panel can have a locking contour or detent thereon adapted to cooperate with a corresponding locking contour in the lid member. The assembled cup lids are stackable so as to minimize space requirements. A method of making the lids is also provided herein.

Still other features and advantages of the present invention will become apparent from the discussion and drawings that follow.

BRIEF DESCRIPTION OF DRAWINGS

The invention is described in detail below in connection with the appended drawings wherein like numerals designate like parts and wherein.

DETAILED DESCRIPTION OF THE INVENTION

The invention is described in detail below for purposes of exemplification and illustration only. Modifications within the scope of the present invention, set forth in the appended claims, will be readily apparent to those of skill in the art. As used herein, terminology is given its ordinary meaning unless a more specific definition is given or the context indicates otherwise.

"Aspect ratio" refers to a ratio of an object length to an object width, for example a length of the closure panel to a width of the same closure panel.

"Generally radially" refers to a direction substantially parallel to or substantially along a diameter of the article.

"Undercut depth" refers to the distance that a recess extends laterally under (or over) a laterally projecting portion of the same thermoformed feature to define a lateral groove in the part. Undercuts are characterized by so-called "negative draft" discussed below. A part or feature has a positive draft if it is not undercut. When used in connection with undercuts of varying depth such as a scalloped undercuts "undercut depth" refers to undercut depth at the maximum lateral depth of the undercut. The undercut depth defines "undercut grooves" which are substantially coextensive with the scalloped engagement tracks.

Figure 2:
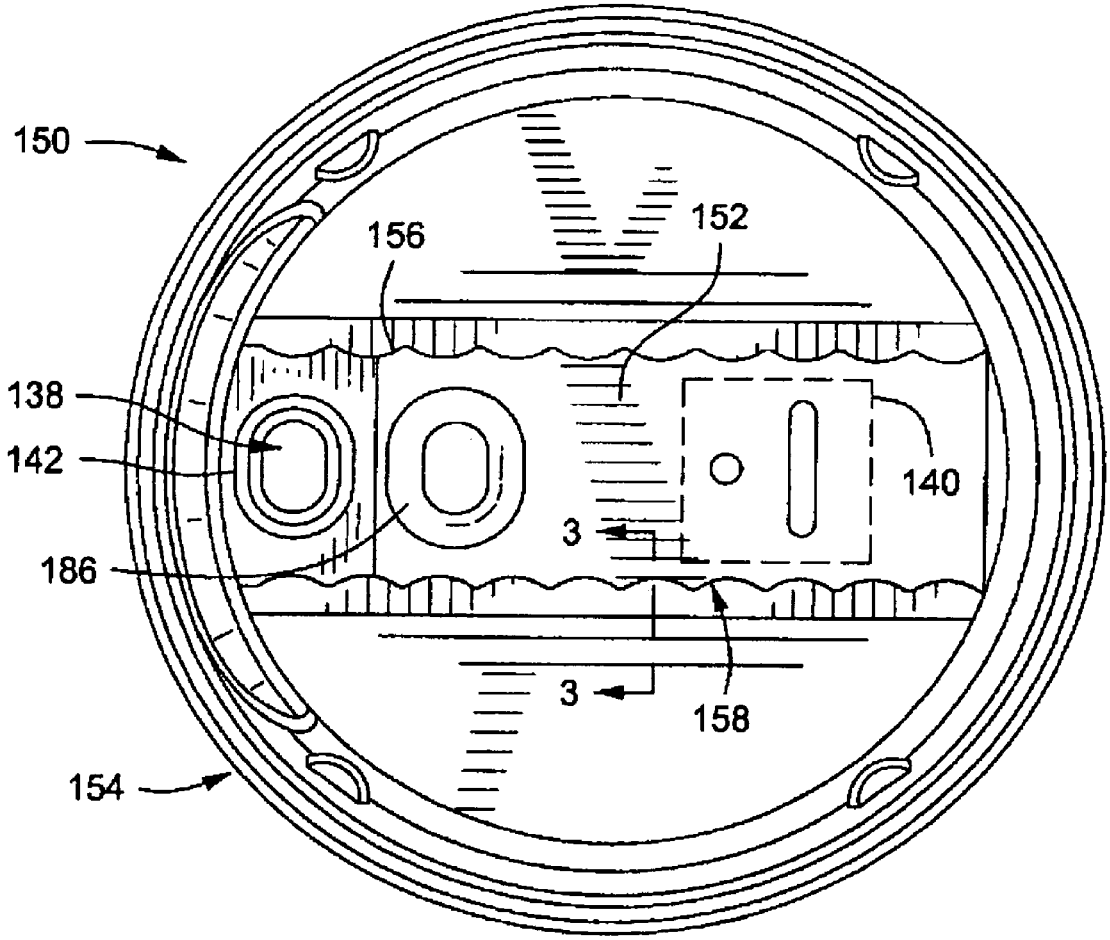
FIG. 2 is a bottom view showing an embodiment of the lid of the invention, wherein the lid has a pair of scalloped engagement tracks.

"Scalloped orientation" means in the form of a continuous series or circular elements or angular projections forming a border. A non-limiting example of a scalloped orientation is shown in FIG. 2, element 158.

"Disposable" means that the object is intended to be disposed of after one or, at most, a few uses.

"Substantially seals" means that there is no or substantially no spillage from the closure panel in the closed position.

Containers, that is, cups, having resealable lids, such as for carrying hot beverages like coffee and tea, have generally not be suitable for disposal after one use due to the costs of the components thereof. Such prior art containers were typically intended for numerous uses and were made of injection molded plastic material. In such prior art reclosable lids prepared from injection molded plastics, the track is generally defined by rails formed in the lid. However, as would be appreciated by one of ordinary skill in the art, it is virtually impossible to form sharp edges in a thermoforming process, such as that from which the reclosable lid of the present invention is manufactured. Sharp corners cannot be readily prepared in thermoforming. Also, the piece must be designed so as to make it removable from the mold without substantial distortion of the piece (e.g., bending or torsioning), which will negatively affect the structural integrity of the piece. To this end, the sharp angles of the engagement tracks depicted in U.S. Pat. No. 6,824,003 would be exceedingly difficult to manufacture in a thermoforming process.

The inventors herein have found that in order to suitably manufacture and assemble a thermoformed reclosable cup lid, the shape the engagement track (which is defined by an undercut grooves and the total distance of the engagement track) is especially important. If the track design is not kept within certain parameters, it has been found that the thermoformed lid cannot be stripped from the mold without severe distortion of the engagement track to the point that the closure panel cannot be inserted into the track to provide a suitable reclosable cup lid. That is, if the lid must be distorted substantially in order to remove it from the mold, the plastic material that makes up the engagement track will be stretched, torn or distorted such that the engagement track no longer has structural integrity. Such loss of structural integrity will cause the closure panel to not be reliably engaged within the engagement track and/or to allow liquid to leak out of the lid during use. Additionally, the inventors have found that assembly of the lid member and closure panel would be difficult if the engagement tracks were made of a solid length of material, as opposed to less than a full track length of material.

Thus, it was determined by the inventors herein that to be able to suitably manufacture and assemble a thermoformed reclosable cup lid, significant adjustments to the engagement track area were required to be made as compared to the design suitably used to prepare an injection molded reclosable cup lid. In particular, it was determined that it was necessary to remove a measurable amount of material from the area of the engagement tracks. Accordingly, the engagement tracks in the lid member of the present invention are scalloped as set forth further herein.

The scalloped engagement tracks of the present invention comprise undercut depths that define undercut grooves, which, in turn, substantially define the scalloped engagement tracks. The undercut depth can be from at least about 0.020 to about 0.060 inches or from about 0.025 to 0.050 inches. The inventors herein have found that when the undercut groove is too deep, the scalloped engagement track will become distorted when removing the lid from the mold. This is believed to be due to the need to bend or torsion the lid in order to eject it from the mold at, for example, the recess 160 in FIG. 3 because, put simply, the lid will become stuck in the mold recess when it is too deep.

The inventors herein have also found that a range of undercut depths is relevant to define a scalloped engagement track that is deep enough to result in reliable retention of the closure panel in the scalloped engagement tracks. The undercut depths of the present invention ensure that the slide will not become disengaged from the track and fall into the beverage in use, while still allowing the lid member to be suitably stripped from the mold.

Additionally important to the manufacturability of the inventive reclosable cup lid is the ability to insert the closure panel into the scalloped engagement track without significant distortion of the scalloped engagement tracks, while still maintaining the integrity of the scalloped engagement tracks to ensure a good fit of the closure panel in the engagement tracks. The closure panel must be quickly and easily insertable into the engagement track during high speed assembly without distortion of the engagement tracks such that the closure panel will be retained in the track during use. These features for high speed assembly are described in detail hereinafter.

To these ends, the inventors herein have found that a scalloping (or fluting) design provides a lid structure that is particularly suitable for the reclosable lid herein. This scalloped orientation is, for example, pictured in FIG. 2 herein. The scallops can range have end-to-end radii from about 0.125 to about 0.30 inches. Since the total number of scallops defines the length of the scalloped engagement track, when the radii are smaller, more scallops will be present; when the radii are larger, fewer scallops will be present. The scalloped engagement tracks are separated by a distance. The scalloped engagement tracks are generally parallel to each other. The undercut depth and the scalloping cooperate to provide the engagement tracks in which the closure panel operates.

It has also been found that insertion and fit of the closure panel can be improved by radiusing and/or chamfering the elongated edges of the closure panel. For example, by chamfering these edges such that the edges of the closure panel are pointed away from the lower surface of the lid member, the closure panel requires less force to insert into the engagement track. Further, a chamfered edge allows the closure to slide (or slip) into the engagement tracks without noticeable stress being placed upon either the closure panel itself or the engagement tracks. The angles can be as discussed further herein.

In some aspects, the arm of the scalloped engagement tracks in which the closure panel resides is not tapered at a free end. Still further, the engagement tracks do not comprise a pair of C-shaped rails. Such C-shaped rails are disclosed in U.S. Pat. No. 6,824,003. The '003 patent states that when a C-shaped rail is tapered at a free end, snapping of the closure member into the lid portion is facilitated. The inventors herein believe that, even with inclusion of the tapered ends, the design of the '003 patent would result in significant distortion of the structure of the C-shaped rails when inserting the closure panel into the lid of the '003 patent. Thus, the inventors believe that the design depicted in the '003 patent would result in loose fit of the closure panel therein.

Further, it is believed that it would be exceedingly difficult to prepare the lid pictured in the '003 patent with use of thermoforming techniques due to the sharp edges in the design. As noted in above, such sharp edges cannot be reasonably applied in manufacturing because the piece would be difficult to remove from the mold after thermoforming. In contrast to the engagement track design disclosed in the '003 patent, the scalloped design of the engagement tracks of the present invention allows the lid member to be easily removed from the mold after thermoforming with little or no distortion of the engagement tracks.

Further, in the present invention, the scalloped configuration of the engagement tracks allows the closure panel to be securably held in the scalloped engagement tracks so as to provide a reclosable seal in the finished cup lid. The inclusion of chamfered outer edges on the closure panel can further improve the ability to assemble the lid to provide a reliable seal in a two-piece reclosable and disposable cup lid. Radiusing of the corners of the closure panel has also been found to improve assembly of the closure panel into the scalloped engagement tracks.

In one form, the invention provides a reclosable and disposable lid for a cup, the lid being made from polymeric material and including a thermoformed lid member provided with a sidewall and a top wall, the top wall having upper and lower surfaces and a drinking aperture at a periphery of the top wall, wherein the drinking aperture communicates with the interior of the cup when the lid is engaged with a cup. The top wall further defines a pair of scalloped engagement tracks depending from the bottom side of the top wall of the lid member. The lid member also has a closure panel post aperture. The lid also comprises a thermoformed closure panel having opposed and chamfered engagement edges along its length and/or radiused corners. The closure panel also comprises an upper surface provided with a post projecting upwardly therefrom. The closure panel post will project through the closure panel aperture when the lid is assembled. The lid further comprises a drinking aperture area which is sealable through slidable engagement of the closure panel within the scalloped engagement tracks.

Figure 4:
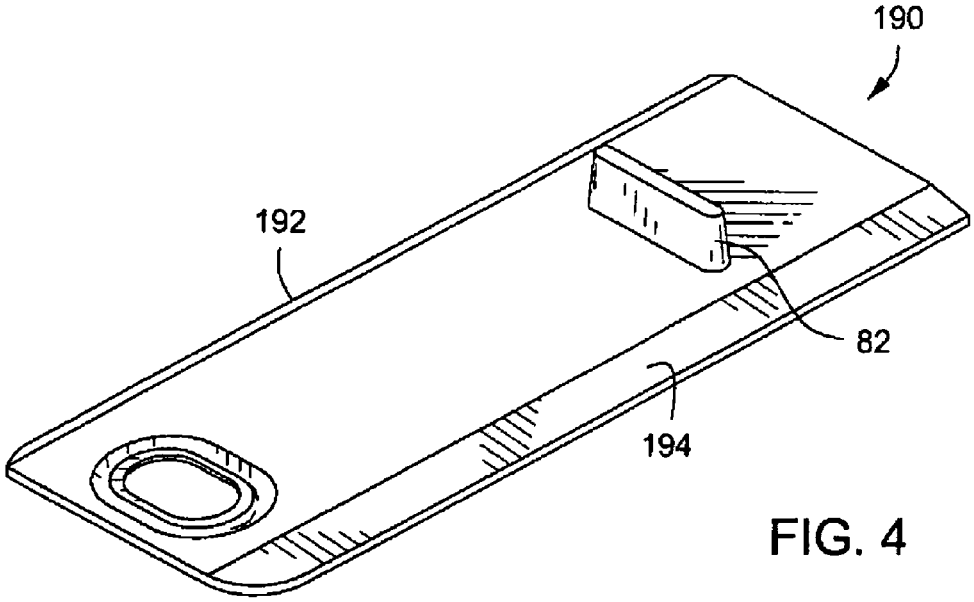
FIG. 4 is a view in perspective of a closure panel having generally chamfered edges.
Figure 5:
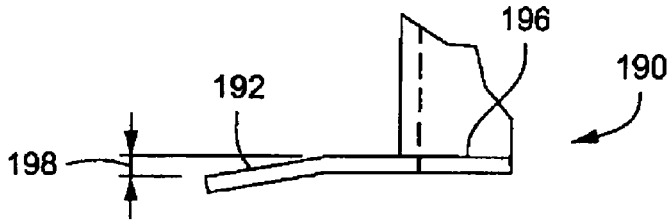
FIG. 5 is a partial end view of the closure panel of FIG. 5.

As noted, the closure panel can be substantially planar along a central portion and chamfered or radiused at respective opposed engagement edges thereof. Chamfering at opposed outer edges of the panel are shown in FIGS. 4 and 5. The opposed engagement edges of the closure panel can be of substantially the same thickness as the closure panel and engage with the generally parallel scalloped engagement tracks. The opposed engagement edges of the closure panel can have a substantially chamfered profile and the undercut grooves of the scalloped engagement tracks can have an S-shaped or modified S-shaped profile (as shown, for example, in FIG. 6) suitably profiled to accept the chamfered opposed outer edges of the closure panel. The closure panel can have chamfered longitudinal edges to provide the angling found to be particularly suitable to a high speed assembly process in which the closure panel can be suitably fitted into the scalloped engagement tracks. A suitable angle of chamfer has been found to be from about 5 to about 15 degrees, or from about 8 to about 12 degrees for the closure panel.

The closure panel can be of a length of from about ½ to about ¾ the length of a diameter of the lid member; the length of the closure panel can be about ⅔ of the diameter of the lid member; as well as an area of the closure panel of from about 5 to about 25% of the area of the top wall. The area of the closure panel is typically not more than from about 25 to about 35% of the area of the top wall of the lid member. The closure panel can have an aspect ratio (as defined herein) of at least about 1.5, or at least about 2.0 or at least about 3.0.

In a significant aspect, the closure panel can include a liquid reservoir thermoformed therein. This reservoir has been found by the inventors herein to significantly reduce the possibility that liquid will collect near the closure panel or on the top of the lid member, typically within or about the drinking aperture area. That is, in use, the beverage will splash in the cup. Some liquid will typically leak into the closure panel area because the closure panel does not have a tight seal between the closure panel and the scalloped engagement tracks. To avoid the liquid from spilling onto a user's clothes during beverage consumption, the reservoir had been found to be significant in at least one form of the present invention.

The depth of the closure panel reservoir is not believed to be critical, however, it should be of sufficient volume to provide suitable storage of excess liquid retained between the closure panel and the scalloped engagement tracks. In non-limiting examples, the closure panel reservoir can be from about 0.40 to about 0.80 inches in width of the closure panel, or from about 0.50 to about 0.70 inches in width of the closure panel. As measured from the top surface of the closure panel, the reservoir depth can be from about 0.030 to about 0.080 inches. The reservoir details are discussed further herein in relation to the discussions in relation to FIGS. 7 and 8 hereinafter.

The possibility of beverage (which is usually darkly colored coffee or tea) being retained between the closure panel and the scalloped engagement tracks and then dripping on clothing is a significant problem for manufacturers of cups and lids used to consume hot beverages. It has been found that the incorporation of the fluid reservoir into the closure panel surface can contain excess liquid retained within the lid (as opposed to on the lid surface) and substantially prevent the liquid from spilling from the lid when the user takes an additional sip. Additionally, if the closure panel incorporates a vent hole in the reservoir, any retained liquid can flow back into the container by way of the closure panel vent hole (which, as discussed herein, is provided by puncturing the lid in the direction of the inner surface of the assembled container), thus facilitating drainage of a retained beverage from the reservoir into the container.

The closure panel can also include an elevation on the top surface of the closure panel that serves as a locking mechanism or detent when the assembled lid is in the closed position. The locking mechanism should be of suitable height to keep the closure panel from inadvertently opening in use and causing the beverage to spill from the drinking aperture. However, the degree of locking must also be balanced with the need for a user to be able to readily open the closure panel when she desires to ingest a beverage within the container. Most suitably, the locking mechanism should provide for one-handed operation. The locking mechanism can be from 0.020 and 0.040 inches in height, or from about 0.024 to about 0.032 inches in height. The locking mechanism in the closure panel will be matched with an associated and complementary contouring in the lid member. The association of the locking contours in the lid member and the closure panel cooperate to provide locking to the closure panel so that the closure panel does not inadvertently open in use.

Significantly, the reclosable cup lid of the present invention can readily be opened by a user with one hand. This is a marked improvement over prior art reclosable cup lids that have a tab lock on the exterior upper lid surface or a bump or a nub on a slide lock. Such designs require the slidable portion of the reclosable cup lid to be pushed over the lid edge or in the case of tear tab lids to be engaged by fitting over the brim or upper surface of the cup outer circumference. In such designs, a user is required to push the nub down or slide the lock out of position—each of which movements require a two-handed operation. In contrast, the locking mechanism of the lid of the present invention provides locking to prevent inadvertent opening of the lid, while still allowing suitable one-handed operation. This one handed operation allows a user to drive or conduct other tasks while still allowing the user to open and close the lid in use.

The closure panel can also include a drinking aperture contour substantially in alignment with the drinking aperture of the lid member. This contouring has been found to provide an improved friction fit between the closure member and the drinking aperture. Specifically, when the closure panel includes a contour thereon that is substantially matched with the drinking aperture opening, the closure panel will exhibit a better seal in use. As currently contemplated, the contour will comprise an indentation in the closure panel upper surface in which the corresponding edges of the drinking aperture contour will sit when the closure panel is in the closed position. To ensure that the closure panel can be suitably opened and closed in use, the closure panel contour should be shallow enough to not result in the edges of the drinking aperture to become locked in the closure panel contour and being difficult for a user to open.

As provided in the present invention, the cup lids are stackable. Such stackability is significant because the lids must be shippable and storable in convenient form. Still further, the cup lids can be configured so that a cup bottim can be stacked on a lid. This configuration is beneficial to improve the ability of a consumer to transport multiple filled containers safely.

The closure panel is suitably provided with venting means, wherein such venting means comprises one or more vent holes. In this form, a vent hole is positioned such that the post aperture communicates with the interior of the lid member when the closure panel is in the open position, thereby venting the interior in the open position to facilitate consumption of a beverage.

In significant form, the venting means comprises one or more holes pierced in the closure panel and one or more holes pierced in the lid member. The vent holes can be from about 0.040 to about 0.080 inches in diameter, or from about 0.050 to about 0.070 inches in diameter.

The respective holes in the closure panel and the lid member where such holes comprise the venting means will suitably not be in substantial alignment such that there is a direct passageway between the lid member and the closure panel. In one aspect, it is important for the venting means to comprise vent holes that are not in substantial alignment in the closure panel and in the top wall of the lid member when the lid is in the closed position. For clarity, this venting means will be referred to herein as "asymmetrical venting means".

In this asymmetrical venting means, the respective vent holes are positioned such that when the closure panel is in the closed position, the hole in the lid member is located in a position of suitable distance to minimize the possibility that the hot beverage will splash through the venting means during transport of the beverage container when the closure member is in the closed position. In one form, the venting hole pierced in the lid member is off set, or substantially off set from the centerline of the lid member. The corresponding venting hole of the closure member is located in a position in the reservoir that will allow suitable venting of the container beverage, while still providing suitable spillage prevention.

The asymmetrical venting means has been found to be particularly well suited for use in the reclosable cup lid of the present invention. It is known that the presence of a vent hole in a cup lid aids in the dispensing of a beverage from a container by reducing the negative pressure difference within the container. The inventors herein have found that the asymmetrical venting means with one of the vent holes placed in the reservoir not only reduces the positive pressure difference when the lid is in the open position for consumption, but will also effectively siphon excess beverage collected the closure panel area during the transport or storage of the beverage. In particular, the two-piece design of the present invention lends itself to beverage entry into the closure panel area as a result of capillary action between the closure panel and the bottom side of the lid member. Placement of the vent holes is optimized to reduce transfer flow carry-over of liquid from the interior of the container to the closure panel and then to the top center closure panel plane of the reclosable cup lid by capillary action.

Whether or not the asymmetrical venting means is used, it can be beneficial to provide the piercing in each of the lid member and the closure member in specific directions. In particular, it has been found by the inventors herein that the piercing in the lid member should be directed through the bottom wall of the lid member so that any barb resulting from the piercing is located on the top surface of the lid member. When the vent hole is provided in this direction, the inventors have found that the closure member is less likely to jam against the barb formed in the plastic lid as a result of the piercing process. In particular, it has been found that the closure member can become jammed if the piercing is directed through the top wall of the lid member because barbs of plastic are formed as a result of the piercing process.

Similarly, it has been found that the closure member is more likely to allow the free flow of trapped liquid when the piercing motion is directed through the top side of the closure member at the base of the reservoir such that the resulting plastic barb is oriented from the top of the closure member through to the bottom of the closure member. When the closure member is pierced in this manners the closure member is more likely to allow free flow of trapped liquid back into the container. Still further, it has been found particularly beneficial to pierce the lid member from the bottom through the top and the closure member from top to bottom and to include a lid member and closure member having these features in a finished container lid. In short, it has been found that the lid member venting hole barb should be oriented toward the top surface of the lid member and the closure panel venting hole barb should be oriented toward the bottom surface of the closure panel.

In significant form, the drinking aperture of the inventive lid is elevated from the top surface of the lid member in the assembled lid. In particular, it has been found that elevation of the drinking aperture provides a more comfortable drinking experience for the user. The drinking aperture should be high enough to provide a comfortable drinking experience, while not being so high off the top surface of the lid to resemble a children's "sippy cup," which has been found undesirable for adult use. In one aspect, the drinking aperture can be elevated from about 0.20 to about 0.30 inches off of the top surface of the lid. The shape of the drinking aperture will generally be in the shape of a flattened oval when viewed from the top of the lid surface. A flattened oval has been shown to provide a comfortable drinking experience, although other suitable shapes may be used.

A specific construction of the inventive lid can include: a) a unitary lid member provided with a sidewall and a top wall, i) the sidewall having at its lower portion a mounting groove configured to engage the brim of a cup and form a seal therewith the top wall also having an upper surface and a lower surface and an elevated drinking aperture at a periphery of the top wall provided with a sealing ridge formed thereabout, the sealing ridge projecting downwardly from the upper surface and a locking contour, the top wall further defining a pair of generally parallel scalloped engagement tracks defined by generally parallel undercut grooves between the lower surface of the top wall and a lower portion of the scalloped engagement tracks, the top wall also having a post aperture disposed inwardly with respect to the elevated drinking aperture; b) a thermoformed closure panel having an upper surface provided with a post projecting upwardly therefrom, as well as a reservoir therein and a venting hole located within the reservoir to facilitate drainage of beverage from the reservoir, a sealing groove formed about a sealing area and a locking contour thereon and opposed scalloped engagement edges along its length; c) the lid member and closure panel being configured such that the longitudinal engagement edges of the closure panel may be slidingly mounted in the scalloped engagement tracks on the lower surface of the top wall of the lid member to reclosably seal the elevated drinking aperture when the closure panel is slid along the scalloped engagement tracks; d) wherein the post of the closure panel projects upwardly through the post aperture when the closure panel is mounted in the scalloped engagement tracks, the post aperture and post thereby cooperating to limit displacement of the closure panel with respect to the lid member; e) a sealing position of the closure panel being further characterized wherein the sealing ridge about the elevated drinking aperture seats in the sealing groove of the closure panel; and f) with the closure panel further comprising a locking contour on the closure panel configured to cooperate with an associated locking contour on the lid member.

In one form, the lids of the invention are made by thermoforming. Generally speaking, thermoforming is the pressing ad/or stretching of heated deformable material into a final shape. In the most basic aspect, thermoforming is the draping of a softened sheet over a shaped mold. In the more detailed aspect, thermoforming is the automatic high speed positioning of a heated sheet having an accurately controlled temperature into a pneumatically actuated forming station whereby the article's shape is defined by the mold, followed by trimming and regrind collection as is well known in the art. Forming techniques other than conventional thermoforming can also be suitable for the manufacture of articles described in the present invention. These include variations such as presoftening the extruded sheet to temperatures below the final melting temperature, cutting flat sections (i.e. blanks) from the sheet, transfer of blanks by gravity or mechanical means into matched molds whereby the blanks are shaped into the article by heat and pressure. Still other alternative arrangements include the use of drape, vacuum, pressure, free blowing, matched die, billow drape, vacuum snap-back, billow vacuums plug assist vacuum, reverse draw with plug assist, pressure bubble immersion, trapped sheet, slip, diaphragm, twin-sheet cut sheet, twin-sheet rolled forming and suitable combinations of the above. Details are provided in J. L. Trone's book, *Thermoforming*, published in 1987 by Coulthard. Pages 21 through 29 of that book are incorporated herein by reference. Suitable alternate arrangements also include a pillow forming technique which creates a positive air pressure between two heat softened sheets to inflate them against a clamped male/female mold system to produce a hollow product. Metal molds are etched with patterns ranging from fine to coarse in order to simulate a natural or grain like texturized look. Suitable formed articles can be trimmed in line with a cutting die with the trimmings being optionally reused. Other arrangements for productivity enhancements include the simultaneous forming of multiple articles with multiple dies in order to maximize throughput and minimize scrap.

Thermoplastic materials are intended to encompass materials suitable for thermoplastic molding of hot cup lids. A material suitable for the lid is a styrene polymer composition, which may be filled or unfilled. The composition can have enough pigment to provide opacity or near opacity. Other suitable materials include polyolefins such as polyethylenes, polypropylenes and mixtures thereof, polyesters, polyamides, polyacrylates, polysulfones, polyetherketones, polycarbonates, acrylics, polyphenylene sulfides, acetyls, cellulosics, polyether imides, polyphenylene ethers/oxides, styrene maleic anhydride copolymers, styrene acrylonitrile copolymers, polyvinyl chlorides, and engineered resin derivatives thereof. These materials can likewise be filled or unfilled. Fillers for any of the polymeric materials can be any conventional materials, as would be well known to one or ordinary skill in the art.

The lid (both lid member and closure panel) can be thermoformed from a sheet of thermoplastic material. Typically, the thermoplastic sheet from which the lids are made has a caliper of from about 10 to about 20 mils (thousandths of an inch), or from about 14 to about 19 mils. The sheet from which the blanks have been cut out can be collected from regrind material and can be recyclable. Yet further, the sheet from which the blanks have been cut can be made from virgin material. Yet, still further, the sheet material from which the blanks have been cut can be prepared from a mixture of virgin and regrind material.

Articles that are thermoformed should be designed so as to permit the die section to be parted free of the molded articles without undue interference with the surfaces of the articles. The surfaces of such articles generally include a so-called positive "draft" with respect to the direction in which the die sections are moved during parting to insure that there is little or no interference between the molded article and the interior surfaces of the die sections during parting. Interference between the articles and the dies is commonly known as "negative draft". The draft may be thought of as the difference between the upper lateral span of a mold cavity and that span below it. A positive draft allows the pattern to be pulled cleanly from the mold, however, undercuts inherently have a negative draft.

In the present invention, the undercut depth and distance required to secure the closure panel to the domed part of the lid is generally minimized in order to reduce the manufacturing difficulties that can be associated with negative draft. In particular, the scalloped engagement tracks can have undercut grooves defined by an inner wall thereof and an outer wall of positive draft, wherein the outer walls of the scalloped engagement tracks have an arcuate profile.

The inventors herein have found that in order to make the reclosable cup lid of the present invention, it is necessary to balance the manufacturability of the lid portion with the need to retain the closure panel within the scalloped engagement tracks. That is, in order to function as a resealable closure for a beverage, the closure panel must slide readily from an open to a closed position when inserted into the scalloped engagement tracks. As noted above, barbing of the lid and the attendant jamming of the closure panel in use can be reduced by piercing the lid member so that the barbs are directed away from the operational path of the closure panel in use.

The reclosable lid of the present invention is assembled by applying a bending force to the lid such that the distance between the generally parallel scalloped engagement tracks is widened. This widening allows the beveled and/or chamfered closure panel to be slidingly fit into the scalloped engagement tracks to provide an assembled reclosable thermoformed cup lid. The closure panel post is oriented so that it projects upwardly through the post aperture toward the top surface of the lid member.

In contrast to the '003 patent discussed previously, the closure panel is not snapped into the scalloped engagement tracks of the inventive lid. Further, the lid member itself is bent to insert the closure panel into the scalloped engagement tracks in the present invention, whereas in the '003 patent, the engagement tracks, i.e., the C-shaped rails, themselves are bent to snap the panel into place.

The invention also provides a method of making a reclosable and disposable lid for a cup comprising: providing a lid member prepared from a thermoformable material, wherein the lid member comprises: providing a thermoformed closure panel having a post projecting upwardly from the chamfered and/or radiused closure panel, wherein a chamfered and/or radiused closure panel is configured to slidably fit within the scalloped engagement tracks, applying a bending force to the lid member to widen the distance between the scalloped engagement tracks, inserting the chamfered and/or beveled closure panel into the scalloped engagement tracks so that the post is disposed upwardly through the post aperture toward the top surface of the lid member, wherein the insertion is conducted while the lid member is undergoing bending; and relieving the bending force after insertion of the closure panel into the scalloped engagement tracks. The lid member comprises: a sidewall suitable for engagement with a cup brim; and a top wall comprising: a drinking aperture at a periphery of the top wall, a pair of generally parallel scalloped engagement tracks separated by a distance, wherein the scalloped engagement tracks are disposed on a lower portion of the top wall portion, wherein each of the tracks comprise a scalloped configuration and an undercut depth, and wherein the scalloped configuration and undercut depth cooperate to provide the engagement tracks; and a post aperture disposed toward a center of the lid member. When the closure panel comprises a locking contour, the lid member will have an associated locking contour adapted to cooperate to provide locking of the closure panel suitable to prevent or substantially prevent the closure panel from inadvertently opening while beverage is contained in a cup upon which the reclosable cup lid is used.

In regards to the manufacturability of the reclosable lid of the present invention, the mechanical stripping action of the stripper plate in the thermoforming apparatus must be timed closely with the air eject function. Firing the stripper plate too soon or too late in conjunction with the air eject blast will tear the track and distort the lid making it unusable.

The reclosable and disposable cup lid of the present invention can be sized to fit any cup upon which cup lids are normally used. The reclosable and disposable cup lid of the present invention is especially suited for use with hot beverages.

Figure 1:
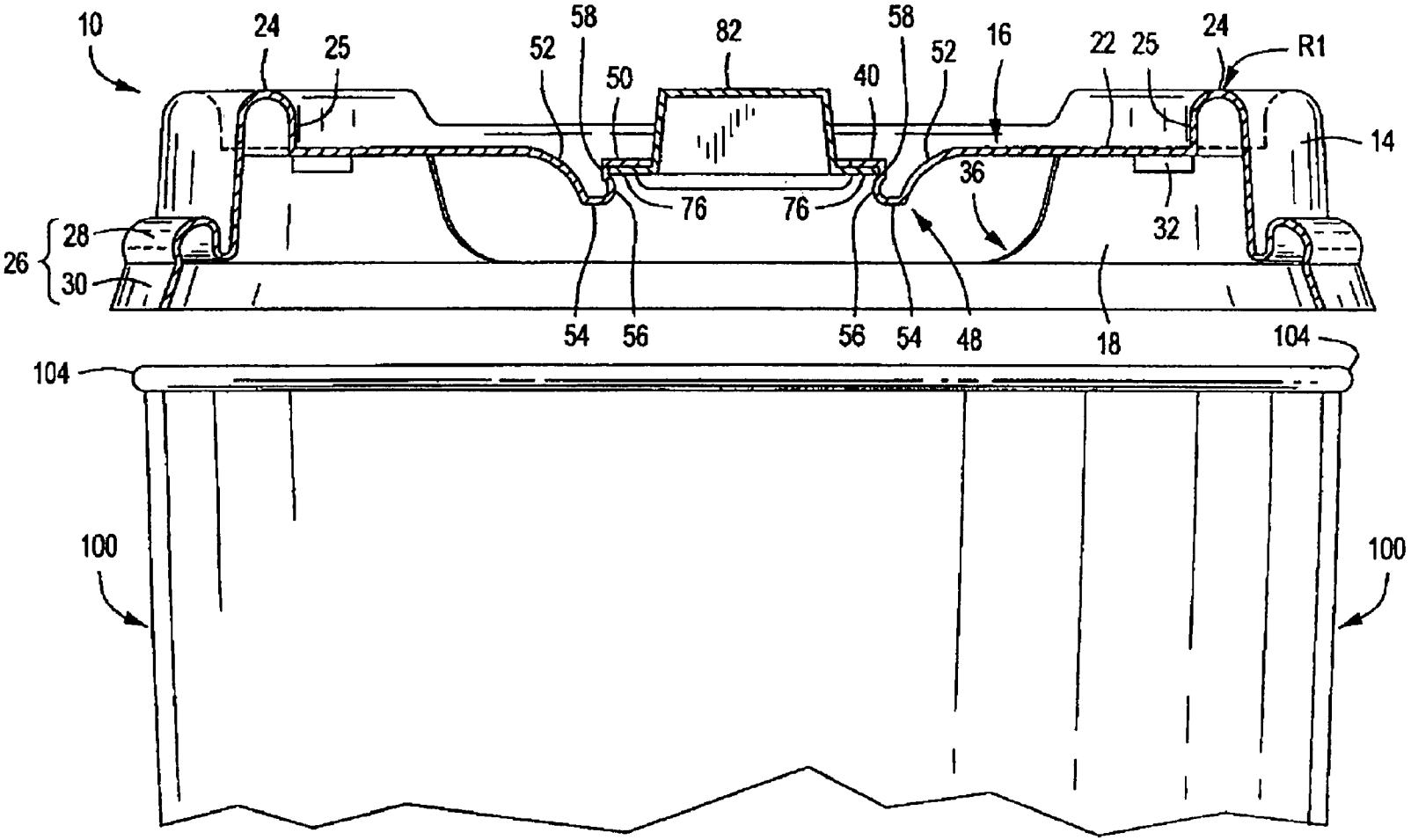
FIG. 1 is a side profile of a reclosable lid incorporating features of the present invention.

FIG. 1 discloses a reclosable lid having features of the present invention. Crown 24 of sidewall 14 is specifically provided to prevent a stacked cup 100 having brim 104 from sliding off of cup 10. In particular, crown 24 is of a height and dimension such that a base end (not shown) of cup 100 will fit against an inner wall surface 25 of crown 24. Further, crown 24 has a height H substantially corresponding to a height of post 82 and because post 82 is positioned away from crown 24, stacking of cups 100 and lids 10 is unaffected by post 82 because post 82 will fit within open area (not shown) of known containers and cups when stacking occurs.

Sidewall 14 further includes a generally annular skirt portion 26 depending therefrom. Skirt portion 26 includes an annular sealing groove 28 configured to sealingly engage with brim 104 of cup 100. Sealing groove 28 is formed adjacent a distal end of sidewall 14 and a generally annular flared trim 30 depending from annular sealing groove 28. Annular sealing groove 28 is configured to engage a brim 104 of cup 100 and form a seal therewith. Thus, annular sealing groove 28 provides one means to prevent leakage of contents from cup 100 when lid 10 is secured thereto. Generally annular flared trim 30 provides a gripping surface for a user to remove or apply lid 10 to cup 100.

Sidewall 14 additionally includes stacking notches 32 formed in sidewall 14 and crown 24. Stacking notches 32 facilitate stacking individual lids 10 with each other and to prevent lids 10 from sticking together when being unstacked.

In FIG. 1 engagement tracks 48 are positioned so as to straddle aligned drinking aperture (not shown) and post aperture (not shown) by a distance sufficient to define a land area 50 therebetween. Land area 50 is visually distinguishable from a remainder of top wall (not shown), and is therefore suitable for receiving indicia or the like thereon. Formation of engagement tracks 48 is such that substantially planar outer surface 22 includes a smooth arcuate transition surface 52 at the outer wall of the track terminating in a flat bottomed surface 54 having a channel 56 opposing transition surface 52. Channel 56 is bounded by a substantially vertical wall 58 terminating at land area 50. Thus, when viewed from outer surface 22, engagement tracks 48 appear to have channel 56 tucked beneath longitudinal undercut edges of land area 50 in top wall 16. The height of post 82 can be only slightly higher than the height of crow 24 above surface 22. This feature allows for cup-on-lid stacking as noted above as well as lid-to-lid stacking discussed further herein. Crown 24 is rounded at its top so as to enhance ergonomics of domed member 12 and make it more comfortable for contact by a user's lips. For example, about a full 0.050 inch radius, RI, can be used for crown 24. Post 82 has opposed longitudinal engagement edges 76.

Referring to FIG. 2, there is shown lid 150 configured in accordance with the present invention. The lid 150 can have a drinking aperture 138 and a male sealing ridge 142 that surrounds and corresponds in shape to the drinking aperture 138. The lid 150 can also have a post aperture 140 positioned radially inward from the drinking aperture 138. Lid 150 has a closure panel 152 as well as dome 154 with a pair of opposed scalloped engagement tracks 156, 158. Scalloped engagement tracks 156 and 158 have undercut grooves with a scalloped geometry along the longitudinal direction. As discussed herein, the scallops facilitate product stripping from the mold and may have a radius of curvature of from about 0.125 to about 0.30 inches or about 0.15 to 0.25 inches. The scalloped geometry also facilitates a deeper undercut groove as is seen in FIG. 3, which is a view of a portion of the profile of the dome along lines 3-3 which is an area maximum inward projection.

Figure 3:
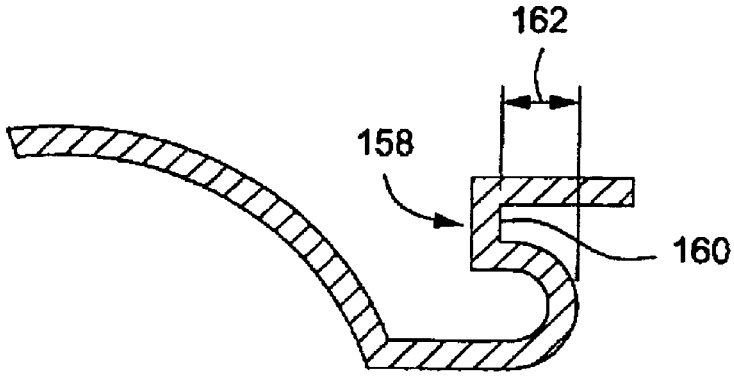
FIG. 3 is a profile of a slide track of FIG. 1 at maximum inward projection.

It is seen in FIG. 3 that undercut groove 160 has an undercut depth 162 from about 30 to about 50 mils or so; a maximum depth that is intermittent with lesser depths. Other possible configurations for the undercut depth are set forth herein.

Referring to FIGS. 4 and 5, there is shown a closure panel 190 having chamfered edges 192, 194 which are perhaps better appreciated by reference to FIG. 5 which is a partial end view of panel 190.

Panel 190 has an upper medial surface 196 that changes direction downwardly at a chamfer angle 198 which may be any suitable angle, for example about 10 degrees or so being suitable.

Figure 6:
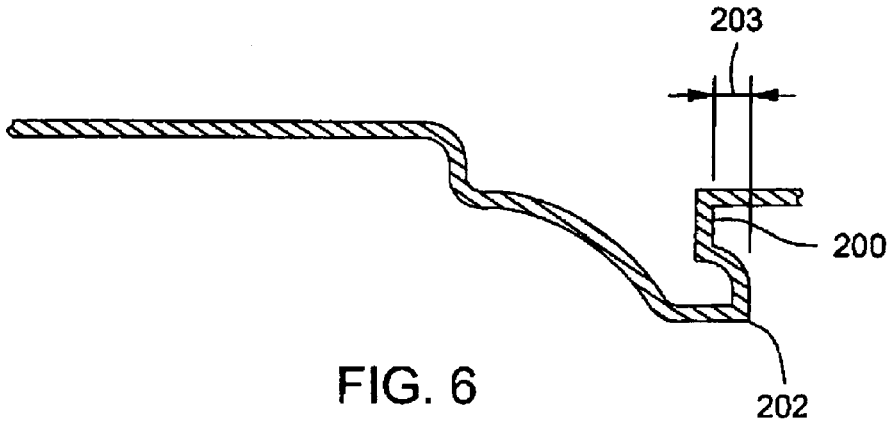
FIG. 6 is a detail showing a profile of the scalloped engagement track of the present invention.

FIG. 6 shows a further embodiment of the present invention wherein the undercut grooves of the scalloped engagement tracks are shaped like a modified "S" with a generally squared-off corner at 202. As with the other Figures discussed herein, 200 is the undercut groove that substantially defines an engagement track and 203 is the undercut depth.

Figure 7:
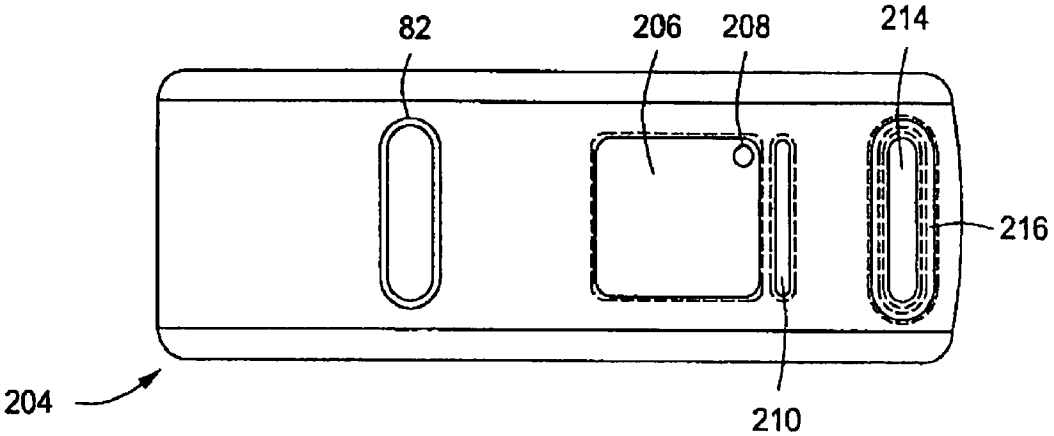
FIG. 7 is a top view of one form of the closure panel of the present invention having a reservoir with a vent hole therein, as well as a locking contour and a drinking aperture contour.
Figure 9:
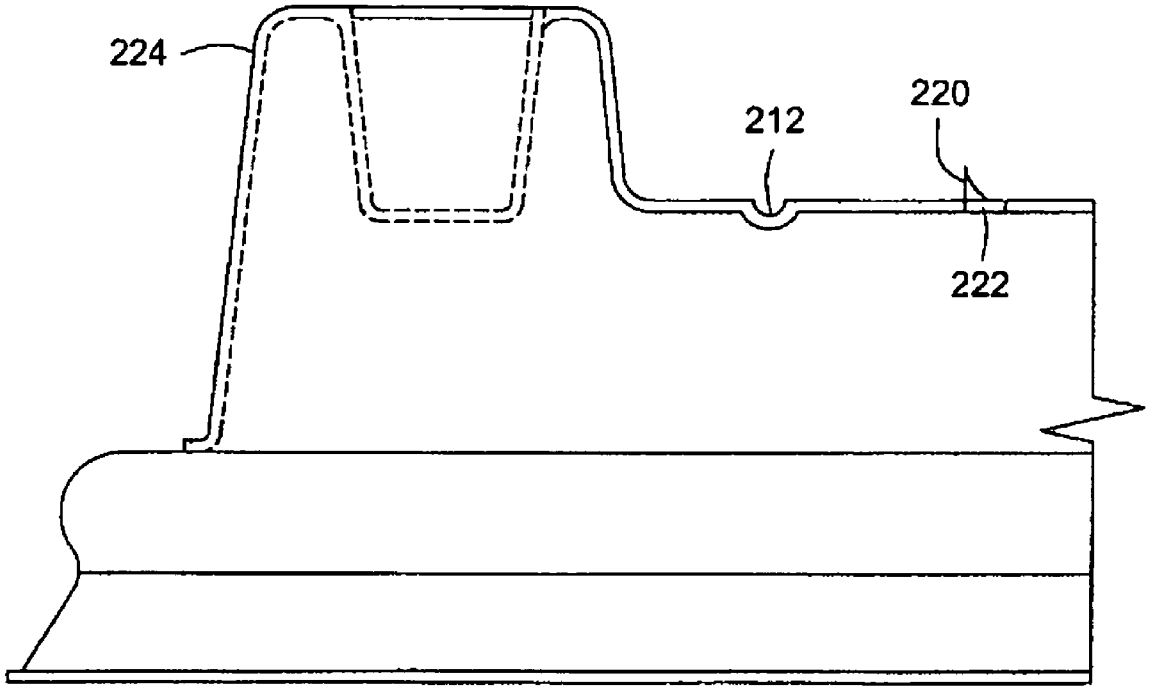
FIG. 9 is a profile showing a configuration of the elevated drinking aperture area of one form of the lid of the present invention.

FIG. 7 shows a closure panel 204 having features of the present invention. Closure panel 204 comprises the post 82. Reservoir 206 comprises vent hole 208 that will drain any beverage (not shown) that may become entrapped within the closure panel 204 by leaking through the scalloped engagement tracks (not shown) of the corresponding lid member (not shown). Closure panel 204 also comprises locking tab 210 which will match with a corresponding locking tab engagement 212 (as shown in FIG. 9). Closure panel 204 also comprises a drinking aperture sealing contour 214 having an outer region 216 that corresponds to the outline of the drinking aperture (not shown) of an associated lid member (not shown).

Figure 8:
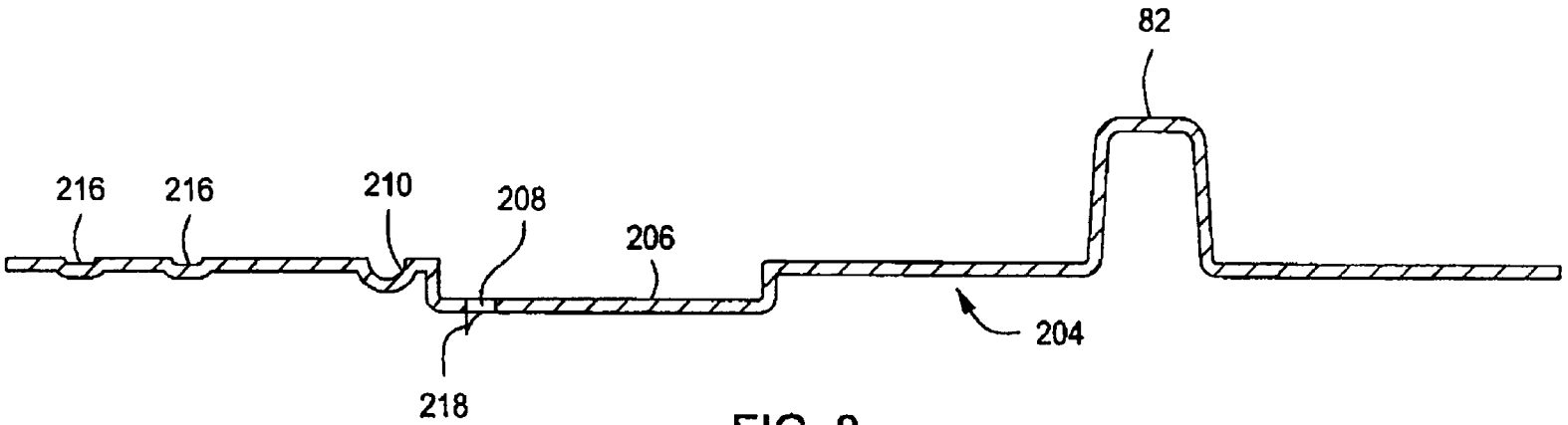
FIG. 8 is a detail showing a profile of the closure panel of the FIG. 7.

FIG. 8 shows a side profile of closure panel 204 of FIG. 7. Closure panel 204 can have a vent hole 208 and a barb 218 extending from a bottom side of the closure panel 204.

FIG. 9 shows a lid member having an elevated drinking aperture 224 in accordance with the present invention. Drinking aperture 224 is open to the container (not shown) to allow drinking of a beverage (not shown) contained therein when a corresponding closure panel (not shown) is in the open position. The lid member can also have a vent hole 222 and a barb 220 extending from the upper side of the top wall 16.

While the invention has been described in connection with numerous features, modifications to those examples within the scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary.

What is claimed is:

1. A reclosable and disposable lid for a cup comprising:

a thermoformed lid member comprising:

a sidewall suitable for engagement with a cup brim; and a top wall having an upper and a lower side wherein the top wall comprises:

a drinking aperture at a periphery of the top wall;

a pair of generally parallel engagement tracks separated by a distance, wherein the tracks are disposed in a longitudinal direction on the lower side of the top wall, wherein each of the tracks comprises a scalloped configuration and an undercut depth; and a post aperture opening at an end of the lid member in a direction opposite of the drinking aperture; and a thermoformed closure panel having a post and a top surface and a bottom surface, wherein the closure panel is insertable into the scalloped engagement tracks by application of a bending force to the lid member suitable to widen the distance between the tracks, thus allowing the closure panel to be inserted into the scalloped engagement tracks such that the post projects upwardly through the post aperture opening, wherein at least one vent hole is present in either or both of the lid member or the closure panel, and wherein the closure panel comprises a reservoir suitable to collect beverage leakage into the scalloped engagement track area from a container engaged with the reclosable cup lid.

2. The lid of claim 1, wherein the scalloped engagement tracks do not comprise C-shaped rails.

3. The lid of claim 1, wherein one of the at least one vent hole is located within a boundary of the reservoir on the closure panel, and wherein one of the at least one vent hole has a barb extending from the bottom surface of the closure panel.

4. The lid of claim 1, wherein at least one vent hole is present in the lid member and comprises a barb extending from the upper side of the top wall, and wherein at least one vent hole is present in the closure panel and comprises a barb extending from the bottom surface of the closure panel.

5. The lid of claim 1, wherein the closure panel comprises a panel locking contour in a position forward of the post aperture, the lid member comprises a lid member locking contour, wherein the locking contours are configured to cooperate, thereby providing a locking mechanism in the lid to substantially prevent the closure panel from opening without engagement by a user.

6. The cup lid of claim 5, wherein the closure member locking contour has a height of from about 0.020 to about 0.040 inches.

7. The lid of claim 1, wherein the reservoir comprises a vent hole within the boundary of the closure panel.

8. A reclosable and disposable lid for a cup comprising:

a thermoformed lid member comprising =a sidewall suitable for engagement with a cup brim; and a top wall having an upper and a lower side wherein the top wall comprises:

a drinking aperture at a periphery of the top wall;

a post aperture opening;

a top wall locking contour; and a first vent hole having a first barb extending from the upper side of the top wall; and a thermoformed closure panel comprising:

a post projecting upwardly from the panel, wherein the post is configured to project upwardly through the post aperture opening;

a reservoir suitable for collection of liquid contained within a container, where such liquid is retained in the area of the closure panel as a result of spillage during transport or consumption of the beverage from the container;

a second vent hole having a second barb extending from a bottom side of the closure panel; and a closure panel locking contour configured to cooperate with the top wall locking contour wherein the respective locking contours cooperate to provide locking of the closure panel member so as to substantially prevent opening of the closure panel without operation by a user, wherein the locking mechanism allows the closure panel to be opened by a user with substantially one handed operation, and wherein the vent holes are not in substantial alignment in the reclosable cup lid when the lid is either in an open or a closed position.

9. The lid of claim 1, wherein one of the at least one vent hole is located within the reservoir.

10. The lid of claim 8, wherein the second vent hole is located within a boundary of the reservoir.

11. The lid of claim 8, wherein the closure panel locking contour has a height of from about 0.020 to about 0.040 inches.

12. A lid for a cup, comprising:

a thermoformed lid member comprising:

a top wall having an upper side and a lower side;

a pair of engagement tracks disposed on the lower side of the top wall, wherein each of the engagement tracks comprises a scalloped configuration and an undercut depth;

a first aperture disposed through the top wall; and a second aperture disposed through the top wall; and a thermoformed closure panel disposed within the engagement tracks of the lid member, the closure panel comprising:

a post projecting through the first aperture, wherein the post is adapted to move the closure panel between an open position and a closed position, and wherein the closure panel covers the second aperture in the closed position;

a reservoir; and at least one vent hole disposed in at least one of the lid member and the closure panel.

13. The lid of claim 12, wherein the scalloped engagement tracks are not C-shaped.

14. The lid of claim 12, wherein the at least one vent hole is located within a boundary of the reservoir on the closure panel, and wherein the at least one vent hole has a barb extending from a bottom side of the closure panel.

15. The lid of claim 12, wherein the at least one vent hole is formed in both the lid member and the closure panel, wherein a lid member vent hole has a barb extending from the upper side of the top wall, and wherein a closure panel vent hole has a barb extending from a bottom side of the closure panel.

16. The lid of claim 12, wherein:

the closure panel comprises a panel locking contour in a position forward of the post aperture, the lid member comprises a lid member locking contour, and the locking contours are configured to cooperate, thereby providing a locking mechanism in the lid to substantially prevent the closure panel from opening without engagement by a user.

17. The cup lid of claim 16, wherein the closure member locking contour has a height of from about 0.020 to about 0.040 inches.

18. The lid of claim 12, wherein the closure panel has chamfered longitudinal edges.

19. The lid of claim 18, wherein the chamfered longitudinal edges have a chamfer angle of from about 5 to about 15 degrees with respect to an upper surface of the closure panel.

20. The lid of claim 12, wherein the undercut depth is of from about 0.02 to about 0.06 inches.

* * * * *